US005383323A

United States Patent [19]

Lewczuk

[11] Patent Number: 5,383,323

[45] Date of Patent: Jan. 24, 1995

[54] MULTICONTAINER PACKAGING SYSTEM

[76] Inventor: Miroslav H. Lewczuk, 3660 Oxford Ave., Bronx, N.Y. 10463

[21] Appl. No.: 59,915

[22] Filed: May 10, 1993

[51] Int. Cl.[6] ..... B65B 27/04; B65B 61/14

[52] U.S. Cl. ..... 53/398; 53/48.4; 53/410; 53/128.1; 53/413; 53/134.1

[58] Field of Search ..... 53/398, 48.3, 48.4, 53/410, 128.1, 441, 556, 413, 134.1

[56] References Cited

U.S. PATENT DOCUMENTS

| | | | |
|---|---|---|---|
| 2,874,835 | 2/1959 | Poupitch | 53/48.4 X |
| 3,046,711 | 7/1962 | Harrison | 53/398 |
| 3,137,109 | 6/1964 | Rapata | 53/398 |
| 4,018,027 | 4/1977 | Curry et al. | 53/48.4 X |
| 4,281,502 | 8/1981 | Bonkowski | 53/398 |
| 4,724,655 | 2/1988 | Lew | 53/398 |
| 5,088,269 | 2/1992 | Thelen | 53/398 |

*Primary Examiner*—Horace M. Culver
*Attorney, Agent, or Firm*—Herbert Dubno; Andrew Wilford

[57] ABSTRACT

Multicontainer packages are formed by longitudinally advancing a plurality of containers in a predetermined array having a predetermined transverse width through a packaging station underneath a flexible harness strip having a plurality of loops and positioning a thin and highly flexible film having a transverse width substantially greater than the transverse width of the array under the harness strip and above the array. Then the harness strip is pressed down on the film and the harness strip and film are pressed down on the containers in the station and to fit the loops over the respective containers while forming in the film at each container a pocket snugly engaging over the respective container and held tight around the respective container by the respective loop.

9 Claims, 4 Drawing Sheets

MULTICONTAINER PACKAGING SYSTEM

FIELD OF THE INVENTION

The present invention relates to a multicontainer packaging system. More particularly this invention concerns a method of and apparatus for packaging a plurality of containers together as a six-pack or the like by means of a carrier harness.

BACKGROUND OF THE INVENTION

It is standard to package a plurality of containers in a carrier harness that has a plurality of loops engaged snugly around the upper ends of the containers, which have beads or lids that project somewhat so that the loops can get under them. Such harness carriers are described in U.S. Pat. Nos. 3,232,422, 3,733,100, 3,874,502, 4,018,331, 4,033,457, 4,109,787, 4,121,712, 4,219,117, 4,462,494, 4,586,742, 5,115,910, and RE29,873. They are applied to the containers by machines such as described in U.S. Pat. Nos. 3,857,422, 4,070,850, 4,817,361, 5,054,257, and 5,117,609.

The main disadvantage of these systems is that they leave the upper ends of the containers exposed. When, as is the usual case, the containers are so-called flip-top cans, this means that the surfaces that will be put into direct contact with the mouth of a person drinking directly from the can might well be fairly dirty. Even if a straw is used, it is certain that dirt on the flip top, which typically is depressed down into the container, will be introduced into the beverage in the can.

It has therefore been suggested in U.S. Pat. Nos. 3,601,253 and 3,601,439 to provide a thin plastic membrane adhered to the surface of the carrier harness. Such arrangements have met no commercial success because the machinery that mounts the harnesses on the containers invariably punctures the membrane, thereby spoiling the package. Other systems such as described in U.S. Pat. Nos. 3,727,752, 4,523,676, 4,606,484, and 5,154,289 provide fairly good sanitary coverage, but use coverings that bear no resemblance to the known carrier harnesses so that the packager must refit with new machinery to use them. In the systems of U.S. Pat. Nos. 4,974,726, 5,099,632, and 5,184,448 a thick plastic sheet replaces the carrier harness and provides a reasonable amount of protection for the containers, but this sheet can only be applied by specialized equipment, and the protection is not complete so that some parts of the container rims are left exposed.

In U.S. Pat. No. 4,724,655 a solution is proposed where a thin plastic film is bonded to the edges of the harness but slack is left in the film so as to form pockets. In theory these pockets allow the installing fingers of the mounting machine to engage into the harness holes and stretch them over the container tops, but in reality these fingers are likely to poke holes through the film. Furthermore bonding the film to the carrier-harness strip is a fairly tricky job that increases the cost of the packaging somewhat.

OBJECTS OF THE INVENTION

It is therefore an object of the present invention to provide an improved multicontainer packaging system.

Another object is the provision of such an improved multicontainer packaging system which overcomes the above-given disadvantages, that is which allows a protective film or the like to be applied over the container tops within the loops of a standard carrier harness.

A further object is to provide an improved method of making such a package which employs standard carrier harnesses and requires minimal modification to the harness-mounting equipment.

Yet another object is to provide an improvement in an apparatus for making multicontainer packages that provides the packages with a protective sanitary film without substantially increasing packaging costs.

SUMMARY OF THE INVENTION

Multicontainer packages are formed by longitudinally advancing a plurality of containers in a predetermined array having a predetermined transverse width through a packaging station underneath a flexible harness strip having a plurality of loops and positioning a thin and highly flexible film having a transverse width substantially greater than the transverse width of the array under the harness strip and above the array. Then the harness strip is pressed down on the film and the harness strip and film are pressed down on the containers in the station to fit the loops over the respective containers while forming in the film at each container a pocket snugly engaging over the respective container and held tight around the respective container by the respective loop.

Such a system can be adapted to existing carrier-harness strips and existing packaging machines fairly easily. The interposition of the film does not interfere with the operation of the equipment, but produces a package that is much more sanitary than has been possible hitherto. The cost of the film is negligible so that the instant invention makes it possible to produce superior packaging at virtually the same unit cost as the prior-art systems.

According to the invention the sheet is formed between the loops with small-diameter throughgoing holes and the film is poked through the holes so as to secure the film to the harness strip before the strip is fitted to the containers. This procedure ensures accurate positioning of the film but is substantially simpler and cheaper than the prior-art systems that bond the film to the strip, and the film attached according to the instant invention does not get damaged by the fingers that spread the container holes to fit the harness over the containers. Furthermore according to the invention the film and strip are severed after mounting on the containers between adjacent holes of the pairs of holes, leaving the film anchored to each side of the transversely throughgoing cut line.

The holes according to the invention can be circular or slits. In particular the holes can be formed as closely spaced pairs of such holes through which the film is poked by means of a forked arm tip. Before this operation the film itself is poked between the two tines of the forked arm tip to ensure its proper positioning, as the light film is fairly hard to handle and position. Alternately the film can be poked through the harness strip by a succession of transversely movable pistons that move longitudinally with the strip, preferably downward, and thus anchor the film to the strip upstream of the station where the harness strip is mounted on the containers. In any case according to the invention the film is not connected in any way to the strip outboard, that is laterally outside, of the container-receiving holes. This nonattachment provides a reservoir of material that can pull up to cover the container tops. The film tucked through the anchor holes further serves as such a material reservoir. When the row of containers is more than two containers wide, it is advisable to form a longitudinal fold or tuck in the film to provide an adequate reservoir or bank of film to allow for the above-described poking of the film through the harness-strip holes.

BRIEF DESCRIPTION OF THE DRAWING

The above and other objects, features, and advantages will become more readily apparent from the following description, it being understood that any feature described with reference to one embodiment of the invention can be used where possible with any other embodiment and that reference numerals or letters not specifically mentioned with reference to one figure but identical to those of another refer to structure that is functionally if not structurally identical. In the accompanying drawing.

SPECIFIC DESCRIPTION

Figure 1:
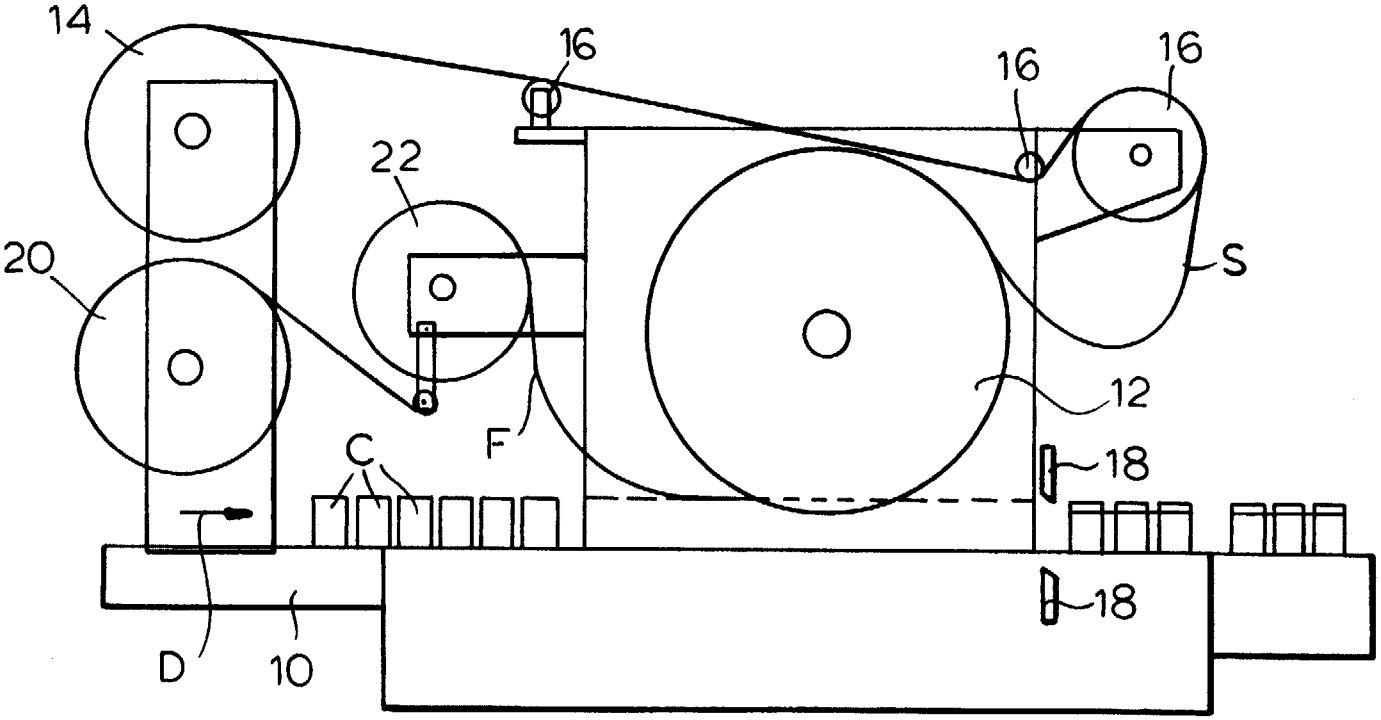
FIG. 1 is a small-scale schematic view of a packaging system according to the invention.

As seen in FIG. 1 two rows of containers C, here two-piece flip-top beverage cans, are displaced longitudinally in direction D along a conveyor 10 underneath an applicator wheel 12 rotatable about a horizontal axis above the continuously moving rows of containers C. A thick and fairly stiff harness strip S of a durable synthetic resin is unwound from a supply roll 14 and runs over various deflecting rollers 16 until it is applied to the surface of the wheel 12 which is provided with standard fingers 17 (shown only in FIG. 5) that spread holes H (see FIG. 3) formed by loops of the strip S and fit them over the tops of the cans C. A cutter shown schematically at 18 severs the strip S between adjacent arrays of cans C along lines L (shown only in FIG. 3) to form individual six packs. This operation and structure is well known in the art and can be seen, for example, in above-cited U.S. Pat. Nos. 4,018,331 and 5,117,609.

According to the invention a thin and highly flexible polyethylene film F of a width W (See FIG. 3) substantially greater than the width w of the array of containers C is pulled by a feed roller 22 from a supply roll 20 and fed loosely in between the tops of the containers C and the thicker harness strip S. Sufficient slack is left in the film F that it can subsequently be bubbled up over the tops of the containers C as described below without stretching to rupture. Thus, as the anchor holes h of the strip S are pushed down over the tops of the containers C, the film F will be pushed by the tops of the containers C up through the holes H in the strip S to form over the top of each container C a snug cap of the film F that is held in all-around engagement by the harness strip S to hermetically enclose the top of the respective container C. In fact the seal is so good between the film F and the containers C that the tops will remain completely dry even if the container package is immersed.

Figure 2:
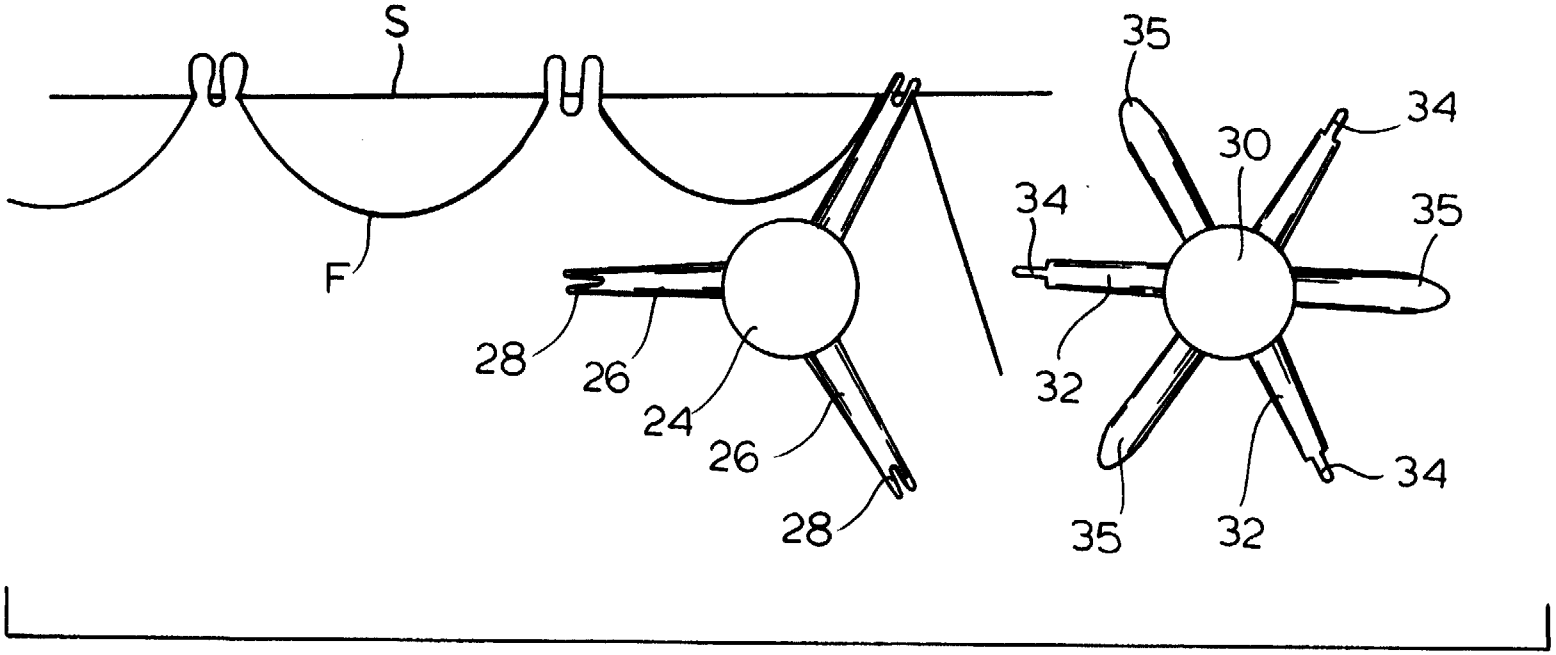
FIG. 2 is a larger-scale view of a detail of an alternative system in accordance with the invention.
Figure 3:
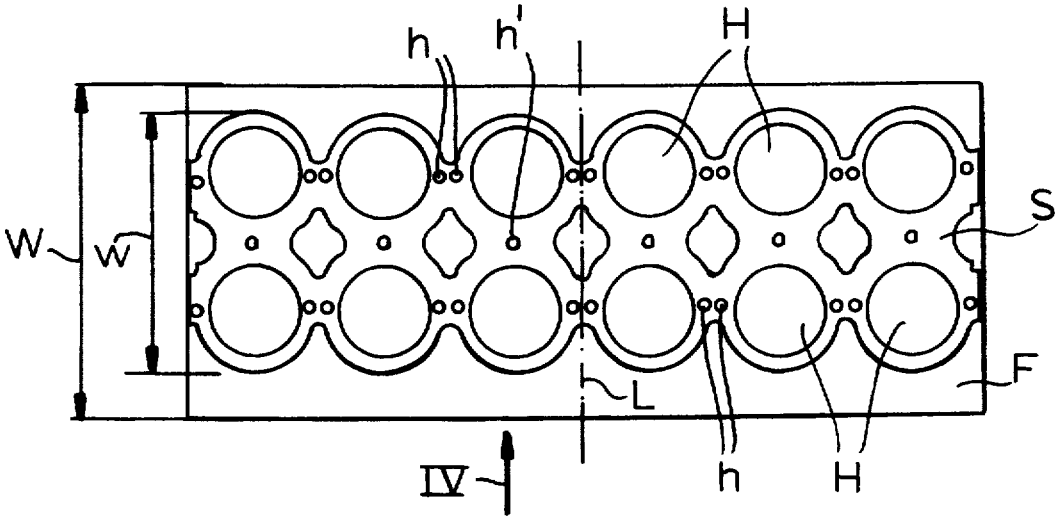
FIG. 3 is a small-scale top view of a harness strip and cover film before application to containers.
Figure 4:
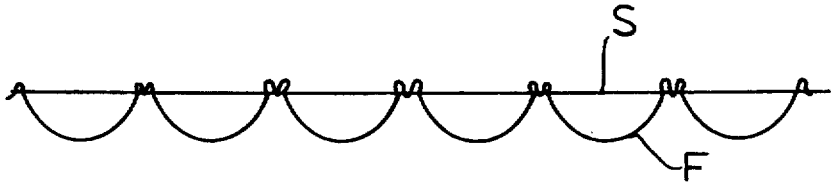
FIG. 4 is a view taken in the direction of arrow IV of FIG. 3.
Figure 5:
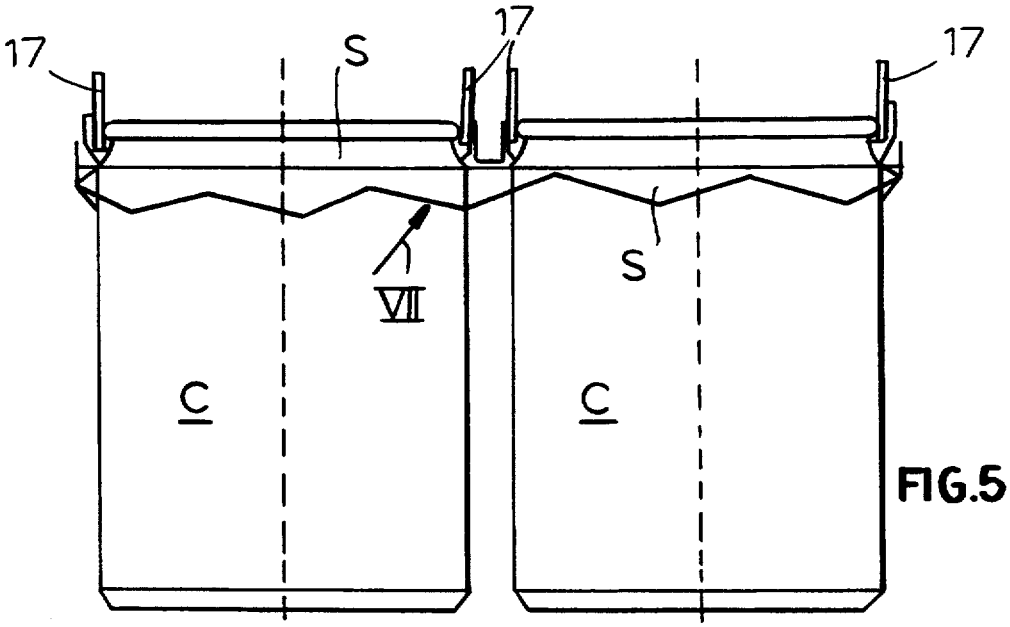
FIG. 5 is an end view of a package according to the invention as the harness strip is being mounted on it.
Figure 7:
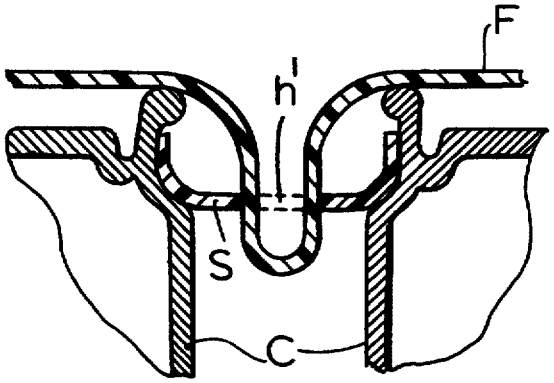
FIG. 7 is a large-scale section through the detail indicated at VII in FIG. 5.

As indicated in FIG. 2 it is possible to secure the film F to the strip S by forming the strip S as seen in FIGS. 3 and 4 with pairs of small anchor holes h between succeeding holes H and to poke the foil F through these anchor holes h by means of a three-arm wheel 24 having individual arms 26 with forked tips 28 that are angularly spaced apart by a rectified distance equal to the longitudinal distance between adjacent pairs of anchor holes h. Another wheel 30 has three angularly equispaced arms 32 whose tips 34 tuck the film F into the forked tips 28 before they in turn push the film F through the anchor holes h. Additional arms 35 on this wheel 30 tuck the film F in between the arms 26 to ensure that there is adequate slack in the film. Further anchor holes h' are formed transversely between adjacent anchor holes h and another multiarm wheel like the wheel 24 pokes the film F through these anchor holes h' as seen in FIG. 7. The film F is left loose between adjacent attachment locations so that when the fingers 17 of the wheel 12 engage through the holes H as shown in FIG. 5 they will not damage this film, and so that the film F can bulge up through the holes H without rupturing.

FIG. 2 clearly illustrates how the film F is left baggy to hang between adjacent attachment locations so that when the strip is pushed down on the containers C it can be pushed up through the holes H without getting holed. In fact the film F is left so baggy that it is not stretched tight and can be depressed down into the recessed tops of the containers C without rupturing, allowing packages according to this invention to be stacked without damaging the film F. Furthermore the anchor holes h' of adjacent pairs are spaced apart in the longitudinal direction so that the cut line L between adjacent six packs (see FIG. 3) runs between them, leaving the film F anchored to both sides of this cut line L.

Figure 6:
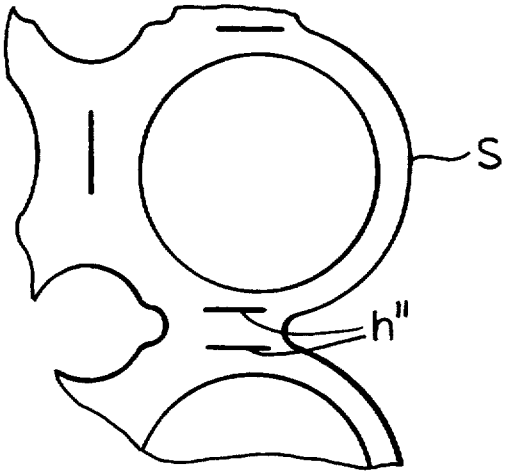
FIG. 6 is a top view of a detail of an alternative harness in accordance with this invention.

FIG. 6 shows how instead of circular anchor holes h the strip can be formed with slits h''.

I claim:

1. A method of forming multicontainer packages, the method comprising the steps of:

a) longitudinally advancing a plurality of containers in a predetermined array having a predetermined transverse width through a packaging station underneath a flexible harness strip having a plurality of loops and formed between the loops with small-diameter throughgoing anchor holes;

b) poking a thin and highly flexible film having a transverse width substantially greater than the transverse width of the array through the anchor holes so as to anchor the film to the harness strip and positioning the harness strip and film with the film under the harness strip and above the array; and c) thereafter pressing the harness strip down on the film anchored to it and the harness strip and film down on the containers in the station and thereby fitting the loops over the respective containers while forming in the film at each container a pocket snugly engaging over the respective container and held tight around the respective container by the respective loop.

2. The multicontainer packaging method defined in claim 1 wherein the anchor holes are circular.

3. The multicontainer packaging method defined in claim 1 wherein the anchor holes are slits.

4. The multicontainer packaging method defined in claim 1 wherein the anchor holes are formed as closely spaced pairs of such anchor holes and the film is poked therethrough by means of a forked arm tip, the method further comprising the step before step a') of a'') tucking the film into the forked arm tip.

5. The multicontainer packaging method defined in claim 4 wherein the anchor holes of each pair are spaced apart longitudinally, the method further comprising the step after step c) of d) transversely severing the film and strip between adjacent anchor holes of some of the pairs of anchor holes to form individual packages.

6. An apparatus for forming multicontainer packages, the apparatus comprising:

transport means for longitudinally advancing a plurality of containers in a predetermined array having a predetermined transverse width through a packaging-station;

strip-supply means for positioning a flexible harness strip having a plurality of loops above the rows of containers in the station;

film-supply means for positioning a thin and highly flexible film having a transverse width substantially greater than the transverse width of the array and formed between the loops with small-diameter throughgoing anchor holes under the harness strip and above the array in the station;

means for poking the film through the anchor holes so as to secure the film to the harness strip; and applicator means for pressing the harness strip down on the film anchored to it and the harness strip and film down on the containers in the station and thereby fitting the loops over the respective containers while forming in the film at each container a pocket snugly engaging over the respective container and held tight around the respective container by the respective loop.

7. The packaging apparatus defined in claim 6 wherein the poking means includes a wheel having a plurality of arms each having a forked tip fittable with the pairs of anchor holes.

8. The packaging apparatus defined in claim 7, further comprising means for tucking the film into the forked tips of the arms.

9. The packaging apparatus defined in claim 8 wherein the means for tucking includes another wheel having a plurality of arms each formed with a tip engageable in the forked tip of the poking means.

* * * * *